US007296880B2

(12) United States Patent
Min et al.

(10) Patent No.: US 7,296,880 B2
(45) Date of Patent: Nov. 20, 2007

(54) INK-JET PRINTER HEAD HAVING LAMINATED PROTECTIVE LAYER AND METHOD OF FABRICATING THE SAME

(75) Inventors: Jae-sik Min, Suwon-si (KR); Young-ung Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 248 days.

(21) Appl. No.: 10/997,977

(22) Filed: Nov. 29, 2004

(65) Prior Publication Data

US 2005/0140748 A1 Jun. 30, 2005

(30) Foreign Application Priority Data

Dec. 26, 2003 (JP) ..... 10-2003-0097576

(51) Int. Cl.
*B41J 2/05* (2006.01)

(52) U.S. Cl. ..... 347/63; 347/64

(58) Field of Classification Search ..... 347/20, 347/44, 47, 56–59, 61–67
See application file for complete search history.

(56) References Cited

U.S. PATENT DOCUMENTS

| | | | | |
|---|---|---|---|---|
| 4,951,063 | A * | 8/1990 | Hawkins et al. | 347/62 |
| 4,968,992 | A * | 11/1990 | Komuro | 347/64 |
| 5,045,870 | A * | 9/1991 | Lamey et al. | 347/59 |
| 5,870,121 | A * | 2/1999 | Chan | 347/59 |
| 6,848,772 | B2 * | 2/2005 | Kim | 347/63 |

FOREIGN PATENT DOCUMENTS

| | | | |
|---|---|---|---|
| JP | 04-39064 | | 2/1992 |
| JP | 06-008441 | | 1/1994 |
| JP | 0026105 | * | 6/1996 |
| JP | 960026105 | * | 6/1996 |
| JP | 11-334075 | | 12/1999 |
| KR | 1996-0026105 | | 6/1996 |

OTHER PUBLICATIONS

Korean Official Action issued on Aug. 18, 2005, for Korean Patent Application No. 2003-97576 (lising 1 reference).

* cited by examiner

*Primary Examiner*—Juanita D. Stephens
(74) *Attorney, Agent, or Firm*—Stanzione & Kim, LLP

(57) ABSTRACT

A heat transfer type ink-jet print head and a method of fabricating the same. A method of fabricating an ink-jet print head includes operations of sequentially laminating a heat generation layer and an electrode layer on a substrate, laminating a protective layer on the top surfaces of the electrode layer and the heat generation layer by sequentially laminating a first protective layer and a second protective layer on the top surfaces of the electrode layer and the heat generation layer, and laminating an ink chamber barrier and a nozzle plate on the top surface of the protective layer to form an ink chamber, wherein defects such as "pin-holes" generated during the formation of the first protective layer are removed by applying a plasma on the first protective layer, and the second protective layer is laminated on the top surface of the first protective layer after any defect produced when laminating the first protective layer is removed.

12 Claims, 7 Drawing Sheets

INK-JET PRINTER HEAD HAVING LAMINATED PROTECTIVE LAYER AND METHOD OF FABRICATING THE SAME

CROSS-REFERENCE TO RELATED APPLICATIONS

This application claims the benefit of Korean Patent Application No. 2003-97576 filed Dec. 26, 2003, in the Korean Intellectual Property Office, the disclosure of which is incorporated herein in its entirety and by reference.

BACKGROUND OF THE INVENTION

1. Field of the Invention

The present general inventive concept relates to an ink-jet print head, and more particularly, to a thermal transfer type ink-jet print head having a protective layer to protect a heat generation layer, and a method of fabricating the same.

2. Description of the Related Art

Conventionally, an ink-jet print heads may be classified into a piezoelectric type, which ejects ink using a piezoelectric member, and a heat transfer type, which ejects ink using bubbles generated when the ink is instantly heated by a heat generation member.

FIG. 1 shows a conventional heat transfer type ink-jet print head.

Referring to FIG. 1, a conventional ink-jet print head 100 comprises a heat generation layer 130, an electrode layer 140, a protective layer 160, which are laminated on a main substrate in this order, and a nozzle 195. Here, the heat generation layer 130 functions to instantly heat ink filled in an ink chamber 115, and the electrode layer 140 functions to apply electric power to the heat generation layer 130.

The protective layer 160 functions to protect the heat generation layer 130. Such a conventional protective layer 160 comprises a first protective layer 170 and a second protective layer 180 sequentially laminated on the top surfaces of the heat generation layer 130 and the electrode layer 140 as disclosed in U.S. Pat. No. 4,335,389. Here, the second protective layer 180 functions to prevent a failure of the heat generation layer 130, which is caused by cavitation force generated when bubbles formed within the ink chamber 115 are contracted after the ink is ejected. In general, the second protective layer 180 is formed by depositing tantalum (Ta) or tantalum nitride (TaNx) on the top surface of the first protective layer 170.

In addition, the first protective layer 170 functions to insulate the heat generation layer 130 and the electrode layer 140 and is formed by depositing any of silicon oxide (SiOx) silicon nitride (SiNx) on the top surfaces of the heat generation layer 130 and the electrode layer 140. The first protective layer 170 is generally formed by depositing SiNx, which is superior to SiOx in heat conductivity, on the top surfaces of the heat generation layer 130 and the electrode layer 140.

Meanwhile, a conventional first protective layer 170 formed as described above has defects such as fine holes usually called "pinholes," which are formed at the time of forming the layer. In particular, these pinholes are inevitably formed due to characteristics of a process of forming such a protective layer and the material thereof. However, when the ink-jet print head 100 is used for a long time, the above-mentioned pinholes principally contribute to cause a failure of the first protective layer 170 due to cavitation force. Such a failure of the first protective layer 170 is more frequently produced at an area C where the heat generation layer 130 and the electrode layer 140 are joined to one another with a step being formed between them. As such, if the first protective layer 170 suffers a failure, a problem can be caused in that the heat generation layer 130 may also suffer a failure by cavitation force. In addition, the heat generation layer 130 may be electrically shorted with the second protective layer 180 or the ink may be filled in the ink chamber 115 through the damaged part of the first protective layer 170, whereby the heat generation layer 130 could also suffer a failure. As a result, the duration and/or quality of the ink-jet print head will be deteriorated.

SUMMARY OF THE INVENTION

Accordingly, the present general inventive concept has been conceived to solve the above-mentioned and/or other problems occurring in the prior art, and it is an aspect of the present general inventive concept to provide an ink-jet print head with a structure improved to prevent a failure of a heat generation layer, thereby enhancing the duration and quality of the ink-jet print head, and a method of fabricating the same.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing an ink-jet print head comprising: a main substrate; an ink chamber formed on the main substrate to contain ink introduced through an ink supply passage with a nozzle to eject ink being formed at a top end of the ink chamber; a heat generation layer laminated on the bottom surface of the ink chamber; an electrode layer laminated on a top surface of the heat generation layer to supply electric power to the heat generation layer, the electrode layer being patterned to a predetermined shape so that some areas of the heat generation layer are exposed to an interior of the ink chamber; and a protective layer laminated on the top surfaces of the electrode layer and the heat generation layer, which are exposed to the interior of the ink chamber, wherein the protective layer comprises a first protective layer laminated on the top surfaces of the heat generation layer and the electrode layer and a top surface of the first protective layer is subject to surface treatment by applying plasma to the top surface of the first protective layer, so that pinholes are removed from the top surface of the first protective layer.

The first protective layer may comprise at least two films sequentially laminated on the top surfaces of the heat generation layer and the electrode layer which are exposed to the interior of the ink chamber, and top surfaces of the at least two films are respectively subject to surface treatment by applying a plasma to the top surfaces.

By this process, it is possible to prohibit the occurrence of pinholes when forming the first protective layer, whereby the failure of the heat generation layer caused by the failure of the first protective layer and pinholes when the ink-jet print head is driven can be prevented.

Meanwhile, it is possible that all of the at least two films essentially consist of SiNx, and a reaction gas used when the plasma is applied is ammonia ($NH_3$).

In addition, the first protective layer can be laminated on the top surfaces of the heat generation layer and the electrode layer which have been subjected to surface treatment by applying the plasma to the top surfaces thereof.

Meanwhile, it is possible that the ink chamber is circumferentially surrounded by an ink chamber barrier laminated on the protective layer and a nozzle plate laminated on a top of the ink chamber barrier, the nozzle being formed through the nozzle plate, and the outlet of the ink supply passage itself and the ink supply passage are coaxially arranged.

Furthermore, it is also possible that the protective layer further comprises a second protective layer laminated on the top surface of the first protective layer, and the second protective layer may comprise at least two films formed from different materials, wherein the at least two films are alternately laminated on the top surface of the first protective layer.

Moreover, it is also possible that the second protective layer comprises first and second films alternately laminated on the top surface of the first protective layer, wherein the first films essentially consist of Ta and the second films essentially consist of TaNx, and wherein the uppermost and the lowermost of the second protective layer being formed with the second films.

By this, because the second protective layer is also formed in a multilayered film structure, the heat generation layer can be more effectively protected.

The foregoing and/or other aspects and advantages of the present general inventive concept may also be achieved by providing a method of fabricating an ink-jet print head comprising the operations of: sequentially laminating a heat generation layer and an electrode layer on a substrate; patterning the electrode layer to cause some areas of the top surface of the heat generation layer to be exposed; laminating a protective layer on the top surfaces of the electrode layer and the heat generation layer; and laminating an ink chamber barrier and a nozzle plate on the top surface of the protective layer to form an ink chamber, wherein the operation of laminating a protective layer comprises the operation of sequentially laminating a first protective layer and a second protective layer on the top surfaces of the electrode layer and the heat generation layer, and the second protective layer is laminated on the top surface of the first protective layer after any defect generated when laminating the first protective layer is removed.

According to an aspect of the present general inventive concept, the removal of defects from the first protective layer is effected by applying a plasma to the first protective layer.

In addition, it is possible that the first protective layer is formed by sequentially laminating at least two films, and the at least two films are formed from a same material.

It is also possible that the at least two films are respectively formed by separately depositing SiNx, and the first protective layer is laminated after the plasma is applied to the top surfaces of the heat generation layer and the electrode layer.

Here, it is possible that the reaction gas used when applying the plasma is ammonia ($NH_3$) and each of the at least two films has a thickness in the range of about 100~1100 Å.

By this process, it is possible to remove any defects such as pinholes formed in each film. In addition, the top surface of each film, which has been subjected to surface treatment, will function as a seed layer to render another film laminated on its top surface to be rigidly bonded and to facilitate the deposition of a next film.

Meanwhile, the second protective layer may comprise one or more first films formed by sputtering of Ta and one or more second films formed by reactive sputtering of TaNx, wherein the first and second films are alternately deposited on a top surface of the first protective layer; an uppermost and a lowermost of the second protective layer are formed with the second films.

In addition, it is also possible that the ink chamber barrier and the nozzle plate are formed through a monolithic lamination process.

By this process, miniaturization and integration of an ink-jet print head can be facilitated

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
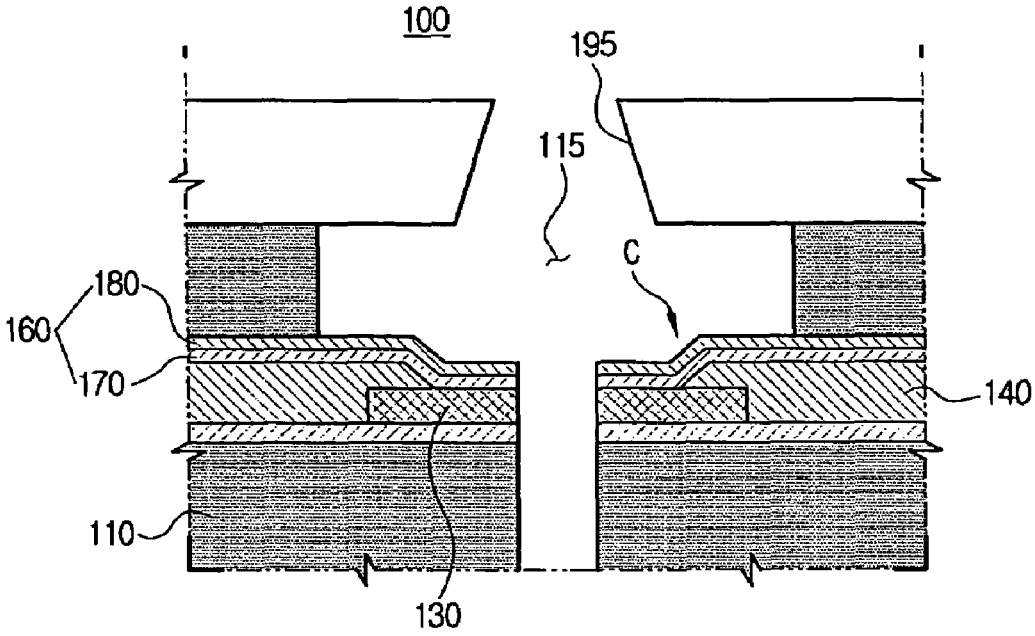
FIG. 1 (PRIOR ART)
FIG. 1 is a cross-sectional view showing a conventional ink-jet print head.

Certain embodiments of the present general inventive concept will be described in greater detail with reference to the accompanying drawings.

In the following description, same drawing reference numerals are used for the same elements even in different drawings. The matters defined in the description such as a detailed construction and elements are nothing but the ones provided to assist in a comprehensive understanding of the general inventive concept. Thus, it is apparent that the present general inventive concept can be carried out without those defined matters. Also, well-known functions or constructions are not described in detail since they would obscure the invention in unnecessary detail.

Hereinbelow, preferred embodiments of the present general inventive concept will be described in detail with reference to the accompanying drawings.

Figure 2:
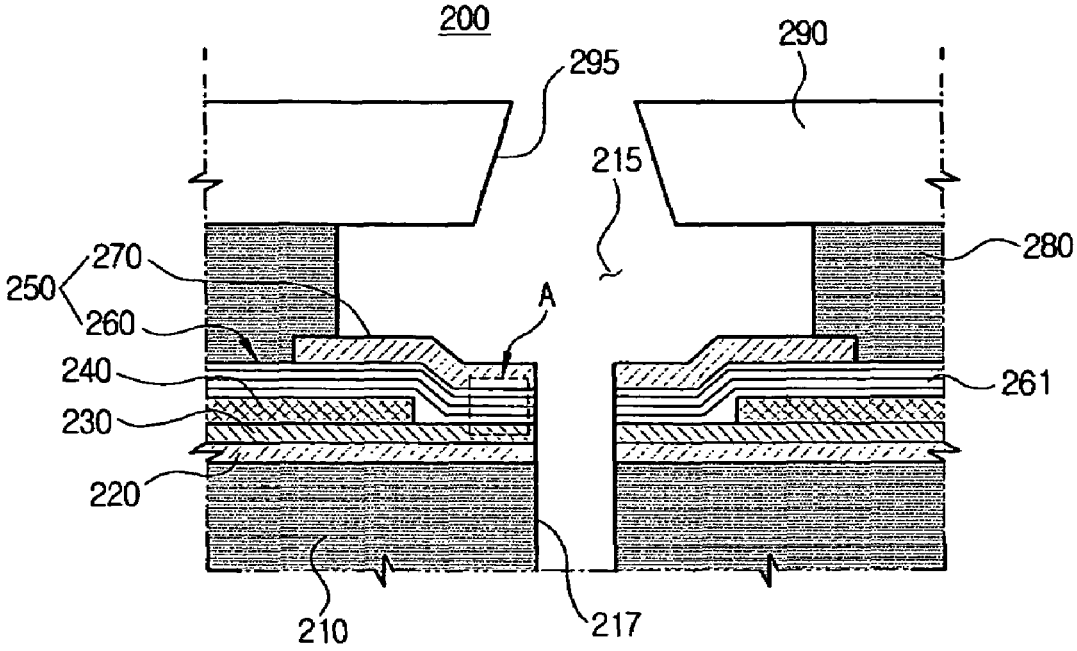
FIG. 2 is a cross-sectional view showing an ink-jet print head according to an embodiment of the present general inventive concept.

FIG. 2 shows an ink-jet print head according to an embodiment of the present general inventive concept. Referring to FIG. 2, the ink-jet print head 200 according to the present embodiment comprises a main substrate 210, a heat insulation layer 220, a heat generation layer 230, an electrode layer 240, a protective layer 250, an ink chamber barrier 280, and a nozzle plate 290.

The heat generation layer 230 functions to instantly heat the ink filled in the ink chamber 215, which is formed by the ink chamber barrier 280 and the nozzle plate 290, and the heat generation layer 230 is typically formed from tantalum-aluminum alloy (Ta—Al alloy). The heat insulation layer 220, which is formed from $SiO_2$, is interposed between the heat generation layer 230 and the main substrate 210, whereby heat transfer from the heat generation layer 230 to the main substrate 210 can be prevented.

The electrode layer 240 functions to apply electric power to the heat generation layer 230, and the electrode layer 240 is typically formed from aluminum (Al), which has a high electric conductivity.

Meanwhile, the protective layer 250 comprises a first protective layer 260 and a second protective layer 270. Here, the second protective layer 270 functions to prevent a failure of the heat generation layer 230 caused by a cavitation force generated when bubbles (now shown) are contracted within the ink chamber 215 after the ink ejection through an a nozzle 295 is completed. The second protective layer 270 also functions to prevent the heat generation layer 230 from being oxidized by ink charged into the ink chamber 215. In addition, the first protective layer 260 functions not only to prevent the failure and oxidization of the heat generation layer 230 as does the second protective layer 270, but also to prevent the heat generation layer 230 from being electrically shorted with the first protective layer 260 or ink charged into the ink chamber 215. Accordingly, the first protective layer 260 may be referred to as an insulation layer or a dielectric layer.

Figure 3:
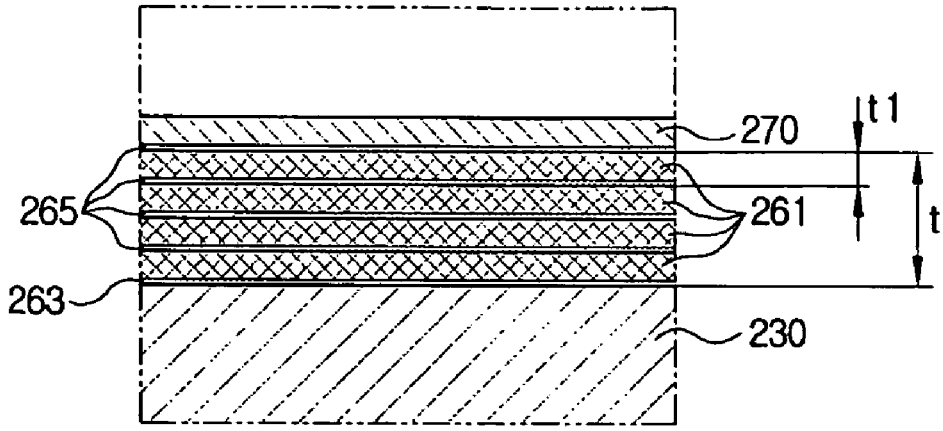
FIG. 3 is an enlarged view of the part A of FIG. 2.

As shown in FIG. 3, the first protective layer 260 according to the present embodiment is subjected to a separate process to remove any defects such as pinholes from the first protective layer 260. According to the present general inventive concept, any defect present in the first protective layer 260 is removed by a plasma applied to the top surface of the first protective layer 260. Such a process to remove defects in this manner is called a "stuffing treatment." The thickness of the first protective layer 260 to effectively execute the stuffing treatment using the plasma is about 1000 Å. However, considering the heat transfer efficiency and insulation efficiency of the first effective layer 260, the total thickness of the first protective layer 260 is typically in the range of about 3000~7000 Å. In order to prohibit the deterioration in efficiency of the stuffing treatment due to this, the first protective layer 260 in this embodiment is formed by sequentially laminating plural films 261, and the top surface of each film is subject to stuffing treatment before the next film is deposited. In addition, it is possible that a thickness t1 of each film ranges between 100~1100 Å to improve the efficiency of removing defects by the stuffing treatment as described above. This is because if a film 261 is formed too thick during a single lamination process, the effect of removing defects by applying the plasma as described above is only effective on the surface of the film 261. In this embodiment, a total of four films 261 are laminated in a thickness t1 of about 800 Å, respectively, thus forming a first protective layer 260. Accordingly, the total thickness t of the first protective layer 260 is about 3200 Å.

Meanwhile, the respective films 261 may be formed from a same material, in particular, a material selected from SiOx and SiNx, which have a good insulation property. The first protective layer 260 in this embodiment is formed by separately depositing SiNx, which is superior to SiOx in heat conductivity, through a plasma enhanced chemical vapor deposition (PECVD) process. Because the films 261 are respectively formed by depositing SiNx as described above, it is possible to introduce gaseous ammonia ($NH_3$) into the reaction area when applying the plasma as a reaction gas. Although reference numerals 265 in FIG. 3 appear to be formed layers, these reference numerals 265 are only provided to aid in pointing out where the stuffing treatment occurs, and no practical layer is formed by such stuffing treatment.

According to the present embodiment, it is possible that the first protective layer 260 is laminated on the top surfaces of the heat generation layer 230 and the electrode layer 240 after the top surfaces have been treated by applying the plasma. Here, it is more preferable that gaseous ammonia ($NH_3$) is introduced into a reaction area on the top surfaces of the heat generation layer 230 and the electrode layer 240 at the time of applying the plasma, thereby using the ammonia as the reaction gas. The top surfaces of the heat generation layer 230 and the electrode layer 240 treated in this manner serve as seed layers to improve a bonding force between the top surfaces of the heat generation layer 230 and the electrode layer 240 and the first protective layer 260 and to allow the films 261 to be more tightly laminated. Although reference numeral 263 in FIG. 3 appears to be a formed layer, this reference numeral 263 is only provided to aid in pointing out where the stuffing treatment occurs, and no practical layer is formed by such stuffing treatment.

Hereinbelow, a method of fabricating the ink-jet print head according to the previous embodiment is described in detail with reference to the accompanying drawings.

Figure 4A:
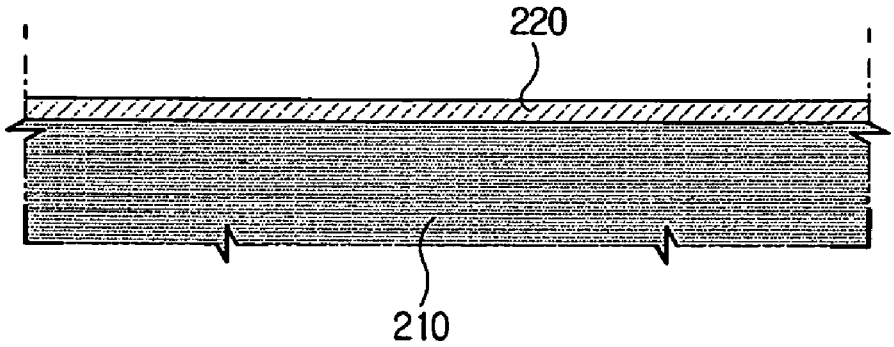
FIGS. 4A to 4I sequential show a process of fabricating the ink-jet print head according to the embodiment of FIG. 2.

At first, as shown in FIG. 4*a*, a heat insulation layer 220 is formed on a main substrate 210.

Figure 4B:
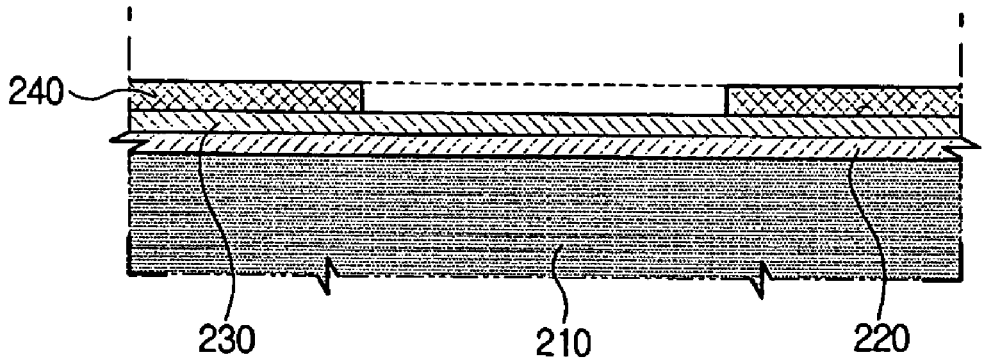

Then, as shown in FIG. 4B, a heat generation layer 230 and an electrode layer 240 are formed on the top surface of the heat insulation layer 220 at which point the electrode layer 240 is patterned through an etching process, such as lithography, to expose some areas of the top surface of the heat generation layer 230 at the bottom surface of an ink chamber 215. Here, the heat generation layer 230 may have a heat-generative resistance member formed from Ta—Al through a vacuum deposition process, and the electrode may be formed by depositing Al.

Figure 4C:
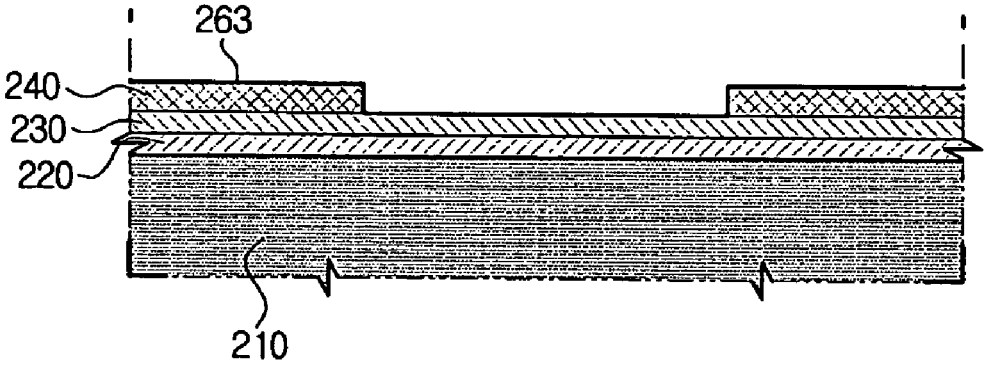

When the deposition of the heat generation layer 230 and the electrode layer 240 is completed, surface treatment is performed on the top surfaces of the heat generation layer 230 and the electrode layer 240 by applying plasma to the top surfaces, as shown in FIG. 4C. At this time, it is preferable to introduce gaseous ammonia ($NH_3$) into the reaction area. Meanwhile, no practical layer is formed through such surface treatment. In other words, although FIG. 4C may appear to illustrate that a layer is formed at reference numeral 263 on the top surfaces of the heat generation layer 230 and the electrode layer 240, reference numeral 263 is not a formed layer, but is only illustrated in this FIG. 4 in order to help understanding of where the stuffing treatment to remove defects occurs.

Figure 4D:
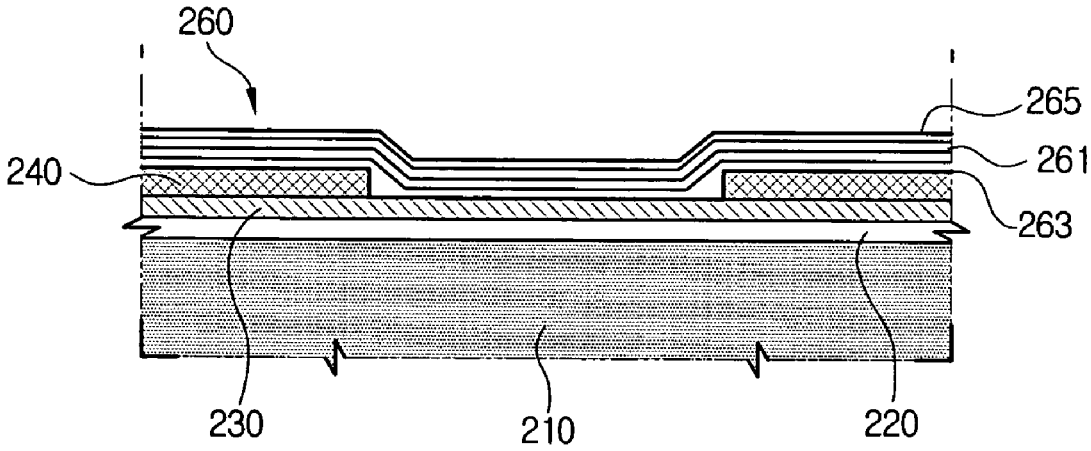

When the surface treatment of the top surfaces of the heat generation layer 230 and the electrode layer 240 is completed, the first protective layer 260 is deposited as shown in FIG. 4D. The first protective layer 260 in this embodiment is formed in a multi-layered film structure with plural films 261 being laminated. The respective films 261 are separately formed from SiNx by repeatedly performing plasma enhanced chemical vapor deposition (PECVD). The plasma enhanced chemical vapor deposition is employed because the electrode layer 240 is formed from Al. That is, because the melting point of Al is about 600° C., the plasma enhanced chemical vapor deposition performed at about 400° C. is employed so as to prohibit the characteristic change of Al. In such a plasma enhanced chemical vapor deposition process, it is possible that $SiH_3$ or $NH_3$ is used as reaction gas, CCP (Capacitive Coupled Plasma) is used as a plasma, and plural frequency generators are employed so that RF (Radio Frequency, 13.56 MHz) and LF (Low Frequency, 400 kHz) can be concurrently applied. It is also possible that the pressure at the time of reaction is controlled using $N_2$ gas.

Meanwhile, it is possible that the respective top surfaces of the films 261 are subject to stuffing treatment by applying plasma to the surfaces similar to the stuffing treatment applied to the top surfaces of the heat generation layer 230 and the electrode layers 240. The plasma applied to the top surfaces of the films 261 is preferably CCP, and more preferably CCP with ammonia ($NH_3$) being used as a reaction gas. By this stuffing treatment, it is possible to remove defects such as pinholes formed in each of the films 261. In addition, each of the films 261 which were subjected to stuffing treatment respectively serves as a seed layer to render another film to be rigidly bonded to its top surface and to facilitate the deposition of a next film. It is to be noted that although it appears in FIG. 4D that reference numeral 265 is a separate layer formed on each of the films 261, reference numeral 265 is only provided to aid in pointing out where the stuffing treatment occurs, and no practical layer is separately formed through such stuffing treatment.

Figure 4E:
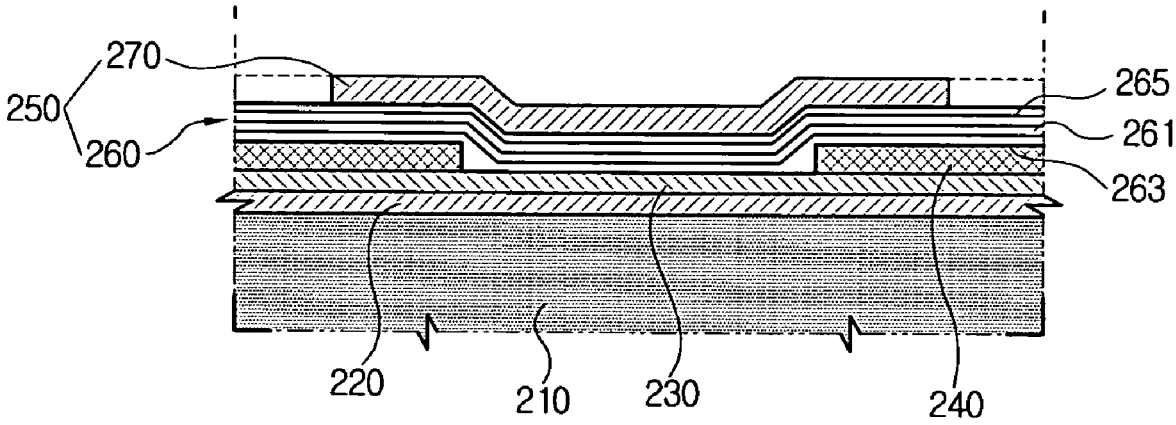

When the deposition of the first protective layer 260 is completed, the second protective layer 270 is laminated thereby completing the protective layer 250, and the second protective layer 270 is patterned to a predetermined shape, as shown in FIG. 4E. It is possible that the second protective layer 270 is formed by depositing either Ta or TaNx on the top surface of the first protective layer 260.

Figure 4F:
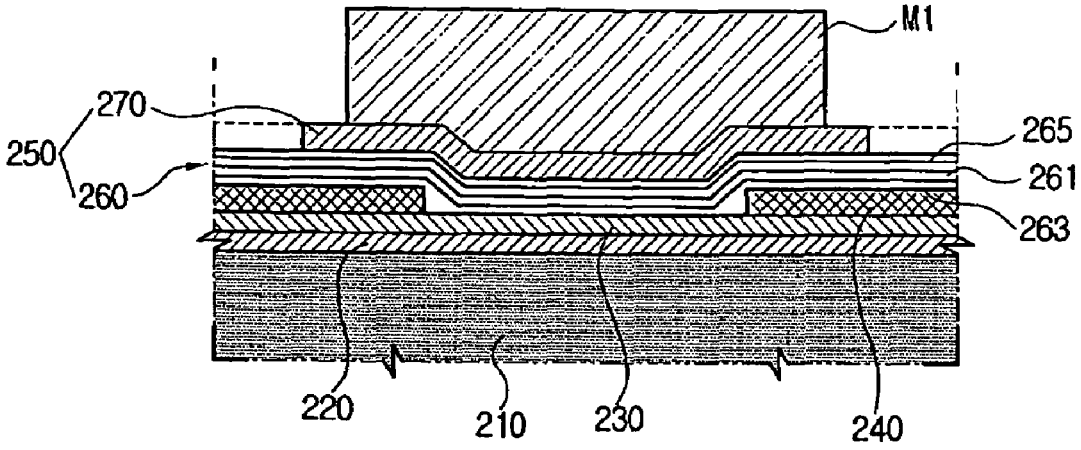

FIG. 4F shows a state in which a photoresist mold (M1) is laminated on the top surface of the second protective layer 270 and then patterned.

Figure 4G:
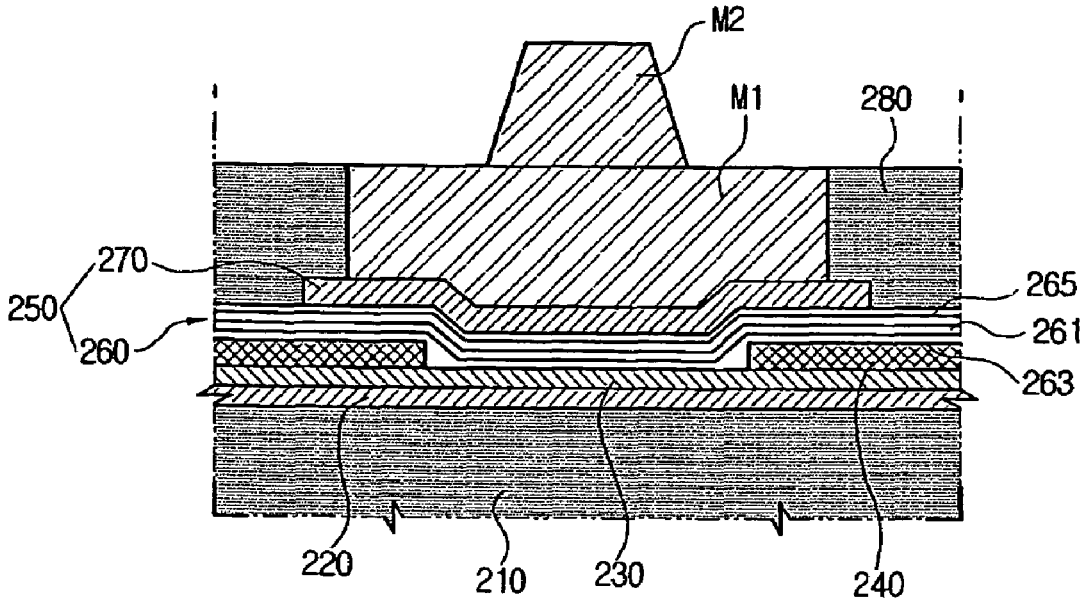

When the patterning of the photoresist mold M1 as described above is completed, a metallic material is electroplated or an epoxy is deposited on the etched area of the photoresist mold M1, thereby forming an ink chamber barrier 280, as shown in FIG. 4G. The process of forming such an ink chamber barrier 280 using a photoresist mold M1 as described above is called as a monolithic laminating process, which can facilitate miniaturization and integration of the ink print head 200 (FIG. 2). Meanwhile, if the ink chamber barrier 280 is formed through such a monolithic laminating process as described above, it is preferable that a nozzle plate 290 with a nozzle 295 is also formed through such a monolithic laminating process using a patterned photoresist mold M2. If such a monolithic laminating process is not employed, the ink chamber barrier 280 and the first protective layer 260 can be bonded with each other using an additional adhesive layer (not shown).

Figure 4H:
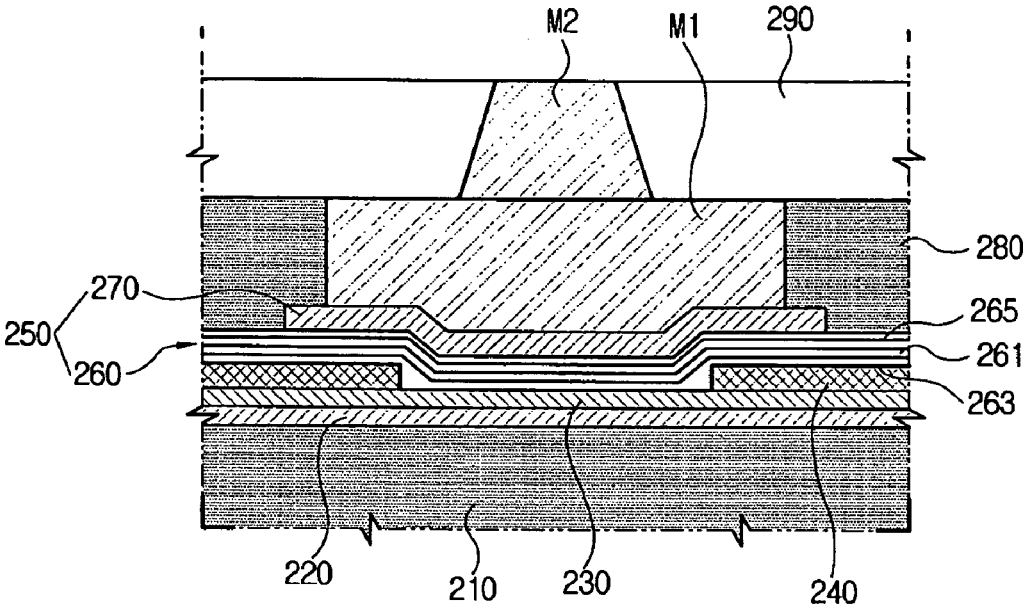
Figure 4I:
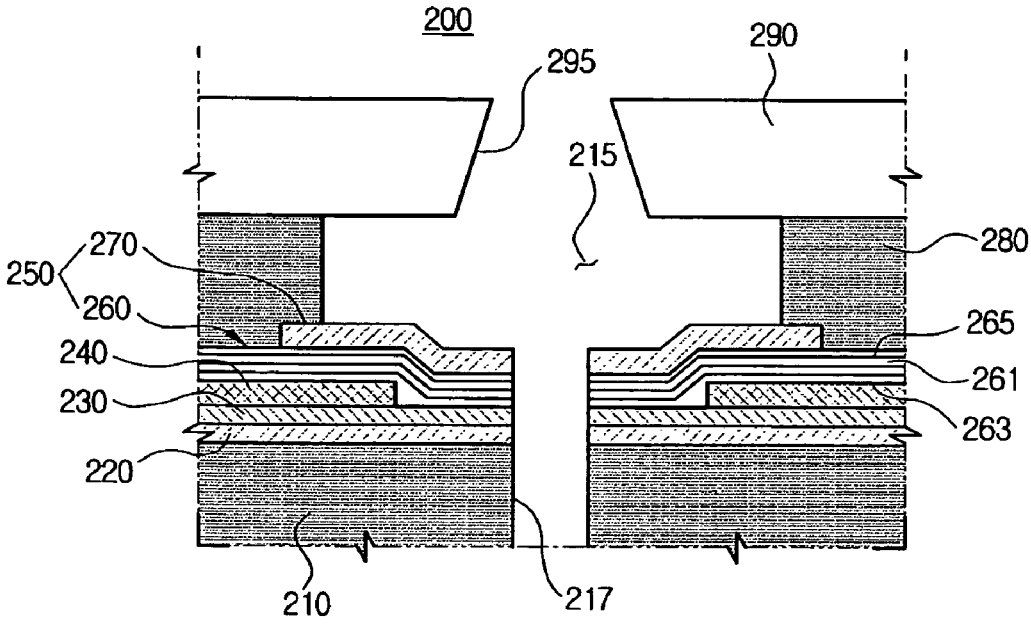

When the lamination of the nozzle plate 290 is completed as shown in FIG. 4H, the photoresist molds M1 and M2 are subject to wet etching and removed to form an ink chamber 215 as shown in FIG. 4I. In addition, the heat insulation layer 220, the heat generation layer 230, the protective layer 250 and the main substrate 210 are etched to form an ink supply passage. At this time, the ink supply passage 217 can be arranged coaxially with the nozzle so as to facilitate miniaturization of the ink-jet print head 200, and the ink supply passage 217 can be formed through a dry etching process.

Hereinbelow, an ink-jet print head according to another embodiment of the present general inventive concept is described with reference to FIGS. 5 and 6.

Figure 5:
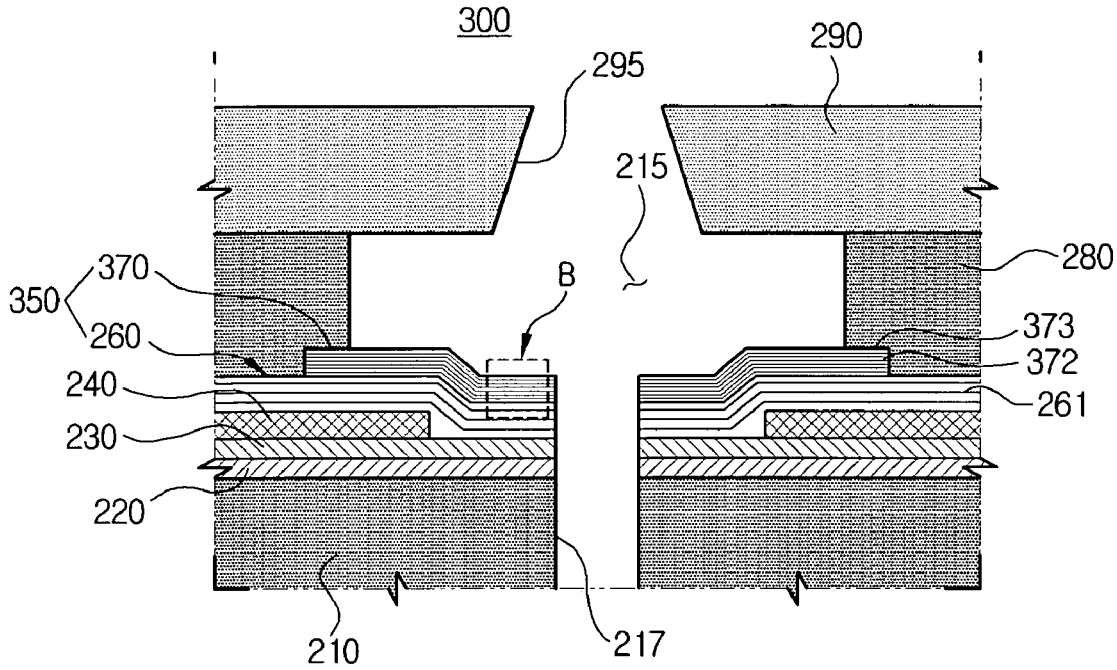
FIG. 5 is a cross-sectional view showing an ink-jet print head according to another embodiment of the present invention.
Figure 6:
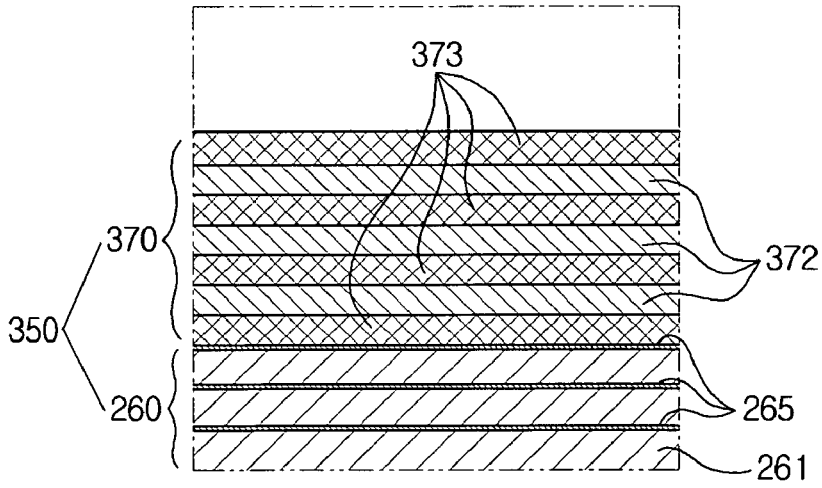
FIG. 6 is an enlarged view of the part B of FIG. 5.

Referring to FIG. 5, the ink-jet print head 300 according to this embodiment is characterized in that a first protective layer 360 has a multi-layered film structure similar to the first protective layer 260 described above, and a second protective layer 370 is formed in a multi-layered film structure, thereby forming a resultant protective layer 350. This is because various properties necessarily required to protect the heat generation layer 230, such as hardness, elasticity, and anti-oxidation cannot be satisfied with a second protective layer 370 formed from a single material (see FIG. 1). That is, if such a second protective layer 370 is formed from Ta only, it is superior in elasticity but can not meet the requirements for hardness and anti-oxidation. Whereas, if such a second protective layer 370 is formed from TaNx only, it is superior in hardness and anti-oxidation but cannot meet the requirements for elasticity. Therefore, in order to solve this problem, the second protective layer 370 according to this embodiment is formed by alternately laminating plural first films 372 and plural second films 373. According to this process, the second protective layer 370 is improved in terms of elasticity, hardness and anti-oxidation, as compared to the conventional second protective 180 (see FIG. 1) formed from a single material. The first films 372 are formed through a sputtering process and the second films 373 are formed through a reactive sputtering process, in which $N_2$ gas is introduced and reacted when sputtering Ta.

Furthermore, the lowermost surface of the second protective layer 370 is preferably formed with a second film 373. By this process, the bonding force between the first protective layer 360 and the second protective layer 370 is enhanced. In addition, the uppermost surface of the second protective layer 370 is preferably formed by a second film 373. According to this process, it is possible to prohibit the oxidation of the second protective layer 370 caused by ink charged into the ink chamber 215. Meanwhile, the remaining technical configuration of the ink-jet print head except the second protective layer 370 is identical to that of the ink-jet print head 200 (see FIG. 2) of the afore-mentioned previous embodiment. Therefore, a detailed description thereof is omitted.

According to the embodiments of the present general inventive concept as described above, a first protective layer is formed in a multi-layered film structure, thereby prohibiting an occurrence of pinholes in the first protective layer. Accordingly, it is possible to prevent a failure of the first protection layer due to an external force exerted in response to ejection of ink. Consequently, it is possible not only to prohibit the failure of a heat generation layer due to such an external force but also to prevent the heat generation layer or an electrode layer from being electrically shorted with the ink contained within an ink chamber or a second protective layer. To this end, the duration and quality of an ink-jet print head can be enhanced.

Moreover, because the second protective layer is also formed in a multi-layered film structure, the heat generation layer can be more effectively protected.

While exemplary embodiments of the present general inventive concept have been shown and described with reference to the representative embodiments thereof in order to exemplify the principle of the present general inventive concept, the present general inventive concept is not limited to these embodiments. It will be understood that various modifications and changes can be made by those skilled in the art without departing from the spirit and scope of the general inventive concept as defined by the appended claims. Therefore, it shall be considered that such modifications, changes and equivalents thereof are all included within the scope of the present general inventive concept.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink-jet print head comprising:

a main substrate;

an ink chamber formed on the main substrate;

a heat generation layer laminated on a bottom surface of the ink chamber;

an electrode layer laminated on a top surface of the heat generation layer; and a protective layer laminated on top surfaces of the electrode layer and the heat generation layer, wherein the protective layer comprises a first protective layer laminated on the top surfaces of the heat generation layer and the electrode layer and a top surface of the first protective layer is subject to surface treatment by applying a plasma thereto to remove pinholes from the top surface of the first protective layer so that the top surface is devoid of pinholes without substantially reducing a thickness of the treated first protective layer.

2. An ink-jet print head as claimed in claim 1, wherein the first protective layer comprises at least two films sequentially laminated on the top surfaces of the heat generation layer and the electrode layer which are exposed to the interior of the ink chamber, and top surfaces of the at least two films are respectively subject to surface treatment by applying a plasma to the top surfaces thereof.

3. An ink-jet print head as claimed in claim 2, wherein all of the at least two films essentially consist of SiNx, and a reaction gas used when applying the plasma is ammonia ($NH_3$).

4. An ink-jet print head as claimed in claim 3, wherein heat generation layer and the electrode layer were subjected to surface treatment to remove pinholes by applying the plasma to the top surfaces thereof.

5. An ink-jet print head as claimed in claim 3, wherein each of the at least two films has a thickness in the range of about 100~1100 Å.

6. An ink-jet print head as claimed in claim 1, wherein the protective layer further comprises a second protective layer laminated on the top surface of the first protective layer.

7. An ink-jet print head as claimed in claim 6, wherein the second protective layer comprises at least two films formed from different materials, wherein the at least two films are alternately laminated on the top surface of the first protective layer.

8. An ink-jet print head as claimed in claim 7, wherein the second protective layer comprise plural first films and plural second films alternately laminated on the top surface of the first protective layer, wherein the first films essentially consist of Ta and the second films essentially consist of TaNx, and wherein the uppermost and the lowermost of the second protective layer are formed with the second films.

9. An ink-jet print head comprising:

a main substrate;

an ink chamber formed on the main substrate;

a heat generation layer formed on a bottom surface of the ink chamber;

an electrode layer formed on a top surface of the heat generation layer; and a plurality of first protective layers formed on top surfaces of the electrode and heat generation layer, wherein the top surface of each of the plurality of first protective layers is devoid of pinholes following a surface treatment using a plasma applied during formation of each of the plurality of first protective layers and wherein the surface treatment does not substantially reduce a thickness of each of the treated first protective layers.

10. The ink-jet head of claim 9, further comprising:

a plurality of second protective layers formed on a top surface of the plurality of first protective layers, comprising at least two different materials.

11. The ink-jet head of claim 10, wherein the plurality of second protective layers comprise a plurality of first films comprising a first material, and a plurality of second films comprising a material different from the first material, alternately laminated on the top surface of the first protective layer.

12. The ink-jet head of claim 11, wherein the uppermost layer and the lowermost layer of the plurality of second protective layers are formed with the same material.

* * * * *